US007162182B2

(12) United States Patent
Tonges et al.

(10) Patent No.: US 7,162,182 B2
(45) Date of Patent: Jan. 9, 2007

(54) IMAGE FORMING DEVICE HAVING A DOOR ASSEMBLY AND METHOD OF USE

(75) Inventors: Jeffrey L. Tonges, Versailles, KY (US); Richard G. Boyatt, III, Lexington, KY (US); Daniel L. Carter, Georgetown, KY (US); Kerry Leland Embry, Midway, KY (US); Larry Steven Foster, Lexington, KY (US); Harald Portig, Versailles, KY (US); David Erwin Rennick, Georgetown, KY (US); Darren Wayne Tosh, Lexington, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 321 days.

(21) Appl. No.: 10/804,488

(22) Filed: Mar. 19, 2004

(65) Prior Publication Data

US 2005/0207780 A1 Sep. 22, 2005

(51) Int. Cl.
*G03G 15/00* (2006.01)

(52) U.S. Cl. ..... 399/110; 399/107; 399/125

(58) Field of Classification Search ..... 399/110, 399/107, 124, 125, 303, 313
See application file for complete search history.

(56) References Cited

U.S. PATENT DOCUMENTS 4,386,838 A 6/1983 Hirabayashi et al.
4,432,632 A 2/1984 Yokota
4,585,329 A 4/1986 Landa
4,615,605 A 10/1986 Kida et al.
4,634,264 A 1/1987 Takahashi
4,639,119 A 1/1987 Isaka
4,642,661 A 2/1987 Dean, II
4,657,372 A 4/1987 Ikeda et al.
4,668,076 A 5/1987 Iseki et al.
4,678,318 A 7/1987 Bisaiji
4,692,018 A 9/1987 Tamura
4,757,344 A 7/1988 Idenawa et al.
4,761,667 A 8/1988 Miyai et al.
4,791,454 A 12/1988 Takahashi et al.
4,862,212 A 8/1989 Tanzawa et al.
4,866,482 A 9/1989 Hirasawa et al.
4,888,620 A * 12/1989 Fujino et al. ..... 399/110
4,896,193 A 1/1990 Kagiura et al.
4,924,267 A 5/1990 Yoshikawa et al.
4,926,219 A 5/1990 Hirasawa et al.
4,943,828 A 7/1990 Manabe et al.
4,987,446 A 1/1991 Mochimaru et al.

(Continued)

*Primary Examiner*—David M. Gray
*Assistant Examiner*—Ryan D. Walsh
(74) *Attorney, Agent, or Firm*—Coats and Bennett, PLLC

(57) ABSTRACT

A door assembly movably positioned to a body of an image forming device. The door assembly includes a first frame and a second frame. The first frame is movably attached to the body, and the second frame is movably attached to the first frame. The movable connections between the frames and the main body cause accurate locating of a photoconductive member mounted on the door assembly within the body. In one embodiment, a contour surface within the body contacts the second frame to locate the second frame within the body. Methods of moving the door assembly are also disclosed including moving the door assembly from an open orientation that is spaced from the body, to a closed orientation that is in proximity to the body. The movement of the door assembly causes interaction between the frames and the body to accurately locate the second frame.

38 Claims, 9 Drawing Sheets

U.S. PATENT DOCUMENTS 5,041,872 A 8/1991 Nukaya et al.
5,061,959 A 10/1991 Kinoshita et al.
5,086,316 A 2/1992 Aoki
5,153,640 A 10/1992 Okabe
5,160,963 A 11/1992 Haneda et al.
5,160,964 A 11/1992 Takahashi et al.
5,220,387 A 6/1993 Tsunoda et al.
5,245,357 A 9/1993 Maruyama et al.
5,249,026 A 9/1993 Kojima
5,253,028 A 10/1993 Gonda et al.
5,255,061 A 10/1993 Matsuura et al.
5,260,743 A * 11/1993 Sakamoto ..... 399/125
5,266,998 A 11/1993 Lee
5,276,479 A 1/1994 Inomata
5,294,960 A 3/1994 Nomura et al.
5,309,211 A 5/1994 Yoshioka
5,323,210 A 6/1994 Inomata
5,367,363 A 11/1994 Kai et al.
5,371,575 A 12/1994 Sekino et al.
5,402,212 A 3/1995 Ito et al.
5,440,373 A 8/1995 Deki et al.
5,442,421 A 8/1995 Kojima
5,452,064 A 9/1995 Inomata
5,528,343 A 6/1996 Tada et al.
5,537,187 A 7/1996 Sekine
5,585,889 A 12/1996 Shishido et al.
5,587,769 A 12/1996 Sawada et al.
5,619,309 A 4/1997 Yashiro et al.
5,646,720 A 7/1997 Song
5,659,847 A 8/1997 Tsuda et al.
5,682,579 A 10/1997 Nomura et al.
5,697,008 A 12/1997 Katoh et al.
5,699,091 A 12/1997 Bullock et al.
5,742,319 A 4/1998 Fukunaga et al.
5,745,824 A 4/1998 Yashiro
5,758,232 A 5/1998 Ikunami
5,787,323 A 7/1998 Nomura et al.
5,787,324 A 7/1998 Iwasaki
5,787,326 A 7/1998 Ogawa et al.
5,797,068 A 8/1998 Otsuki et al.
5,802,432 A 9/1998 Coffey et al.
5,815,644 A 9/1998 Nishiuwatoko et al.
5,839,032 A 11/1998 Yasui et al.
5,842,095 A 11/1998 Kitamura
5,887,228 A 3/1999 Motohashi et al.
5,897,244 A 4/1999 Miyazaki et al.
5,907,749 A 5/1999 Nomura et al.
5,907,751 A 5/1999 Kawaguchi et al.
5,920,752 A 7/1999 Karakama et al.
5,930,564 A 7/1999 Ookaji
5,937,240 A 8/1999 Kanno et al.
5,943,529 A 8/1999 Miyabe et al.
5,950,050 A 9/1999 Shirasaki et al.
5,966,566 A 10/1999 Odagawa et al.
5,978,626 A 11/1999 Nagamine et al.
6,041,203 A 3/2000 Suzuki et al.
6,075,958 A 6/2000 Gotoh et al.
6,118,961 A 9/2000 Nomura et al.
6,125,251 A 9/2000 Shiraishi et al.
6,134,404 A 10/2000 Iwai et al.
6,163,666 A 12/2000 Hosokawa et al.
6,173,140 B1 1/2001 Suzuki et al.
6,215,970 B1 4/2001 Yoshikawa et al.
6,330,410 B1 12/2001 Okabe
6,347,204 B1 2/2002 Kurosawa
6,366,749 B1 4/2002 Koumoto
6,377,765 B1 4/2002 Shishido et al.
6,384,940 B1 5/2002 Kawai et al.
6,453,135 B1 9/2002 Sameshima et al.
6,453,136 B1 9/2002 Yasumaru
6,477,346 B1 11/2002 Yahagi
6,498,915 B1 12/2002 Yamaguchi et al.
6,549,737 B1 4/2003 Sano et al.
6,799,011 B1 * 9/2004 Abe et al. ..... 399/303
6,973,279 B1 * 12/2005 Yokoi ..... 399/124
2001/0028810 A1 10/2001 Yamaguchi et al.
2001/0055499 A1 12/2001 Sato
2002/0102110 A1 8/2002 Kida
2003/0049035 A1 3/2003 Ochiai et al.
2003/0049047 A1 3/2003 Suzuki et al.
2003/0072586 A1 4/2003 Kamano et al.

* cited by examiner

IMAGE FORMING DEVICE HAVING A DOOR ASSEMBLY AND METHOD OF USE

BACKGROUND

Image forming devices require user intervention for proper operation. One user intervention is clearing the media path during a paper jam. Access to the media path is often difficult because of the complex mechanical design in existing devices. The media path may be located within the interior of the device making it very difficult to remove a jammed media sheet. Further, the user may have access to a limited section of the media path and be able to remove only a portion of the jammed media sheet. A torn remainder is left in the device that must somehow be removed prior to restarting image formation.

Another user intervention requires mounting cartridges within the device. Cartridge mounting may occur initially when the machine is first used, or throughout the device life to replace exhausted cartridges. The complex design again makes it difficult for the user to access the cartridges. Difficult cartridge mounting locations may also result in the user getting toner on their hands and fingers by inadvertently contacting the toner outlet on the cartridge.

Some existing devices provide for an adjustable media path and cartridge mounts to ease the user intervention. The media path and cartridge mounts may be positionable between an operational position during image formation, and a non-operational position to ease user access for media jam removal and cartridge installation respectively. It is important that these adjustable elements be accurately located in the operational position. Inaccurate locating of the elements may result in image forming defects, increased media jams, and other detrimental effects.

Further, the device should be constructed in an economical manner. Price is one of the leading factors when a user makes a purchasing decision. Improvements to user intervention should add to functionability, but not at a price that will drive away potential users.

SUMMARY

The present invention is directed to a door assembly on an image forming device. The door assembly is positionable between open and closed orientations to position a cartridge unit relative to a body of the device.

In one embodiment, the invention includes a first frame pivotally mounted to the body at a first pivot and positioned between open and closed orientations. A second frame is pivotally connected to the first frame at a second pivot. In an open orientation, the second frame is spaced from the body and moved relative to the first frame. In the closed orientation, the first frame is moved inward with the second frame being registered relative to the body.

In another embodiment, the device comprises a body with a developer member. A first frame is connected to the body at a first pivot with the first frame being positioned between a first orientation with a second end distanced from the body, and a second orientation with the second end in proximity to the body. A second frame having a photoconductive member is attached to the first frame at a second pivot. The second frame pivots separately from the first frame to position the photoconductive member in contact with the developer roll when the first frame is in the second orientation.

In another embodiment, a number of developer members are positioned within the body and a number of photoconductive members are positioned on the second frame. Each of the photoconductive members has substantially the same travel length as the first frame and second frame are moved from an intermediate orientation to a closed orientation.

DETAILED DESCRIPTION

Figure 1:
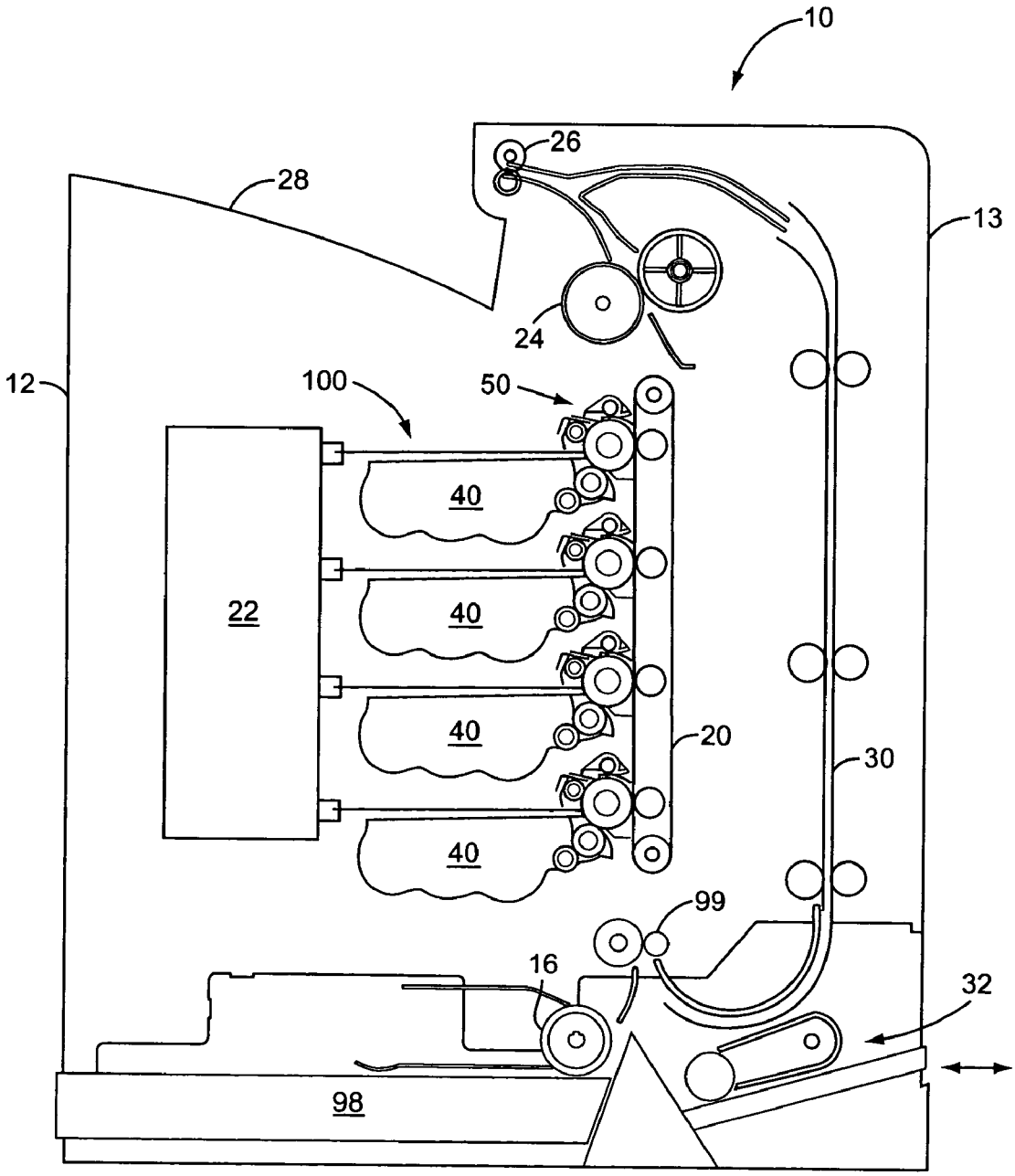
FIG. 1 is a schematic view of an image forming device according to one embodiment of the present invention.

FIG. 1 depicts a representative image forming device, such as a printer, indicated generally by the numeral 10. The image forming device 10 comprises a main body 12 and a door assembly 13. A media tray 98 with a pick mechanism 16, or a multi-purpose feeder 32, are conduits for introducing media sheets into the device 10. The media tray 98 is preferably removable for refilling, and located on a lower section of the device 10.

Media sheets are moved from the input and fed into a primary media path. One or more registration rollers 99 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member 51 within the image forming units 100. The media sheet with loose toner is then moved through a fuser 24 that adheres the toner to the media sheet. Exit rollers 26 rotate in a forward direction to move the media sheet to an output tray 28, or rollers 26 rotate in a reverse direction to move the media sheet to a duplex path 30. The duplex path 30 directs the inverted media sheet back through the image formation process for forming an image on a second side of the media sheet.

Figure 2:
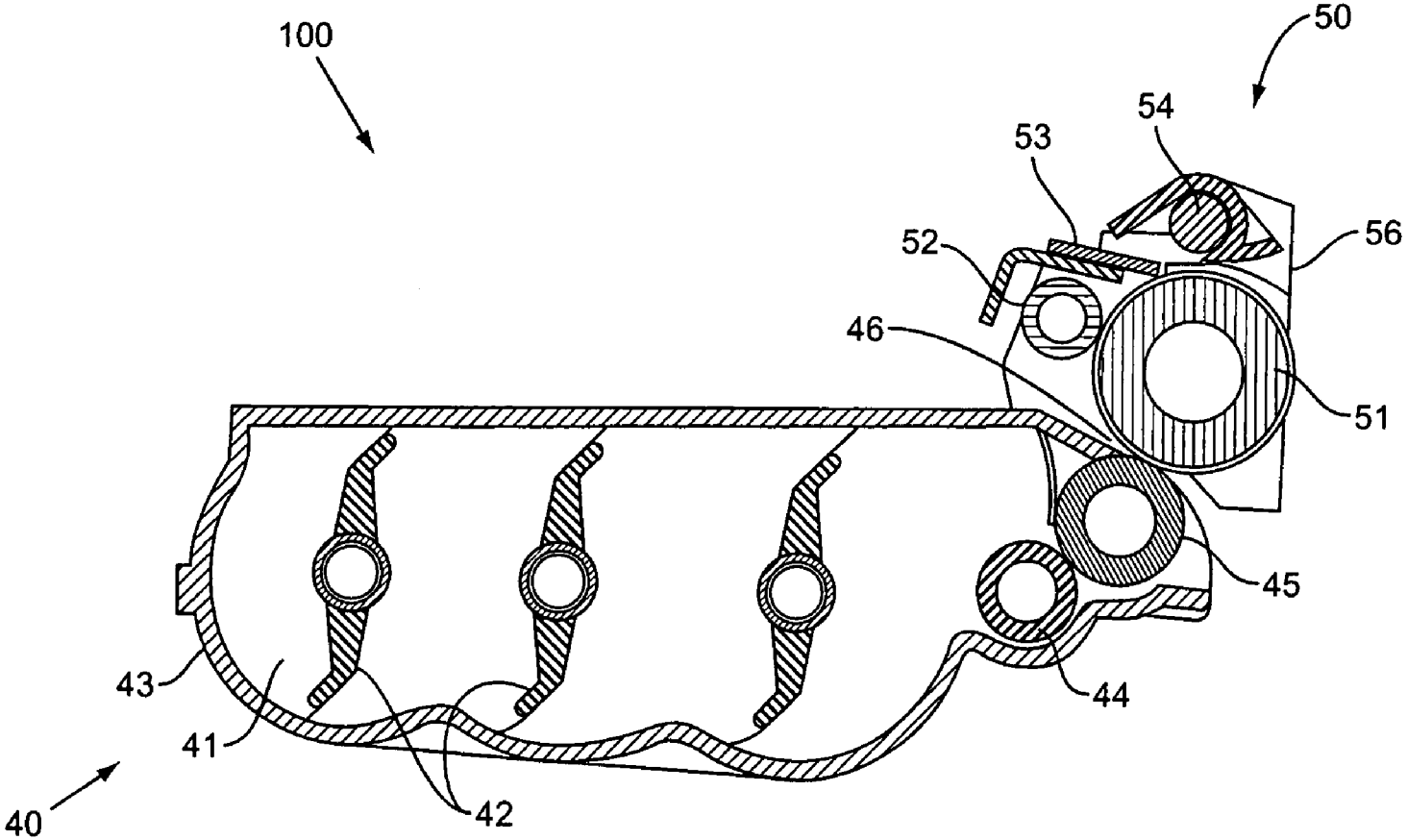
FIG. 2 is a cross-sectional view of an image forming unit according to one embodiment of the present invention.
Figure 3:
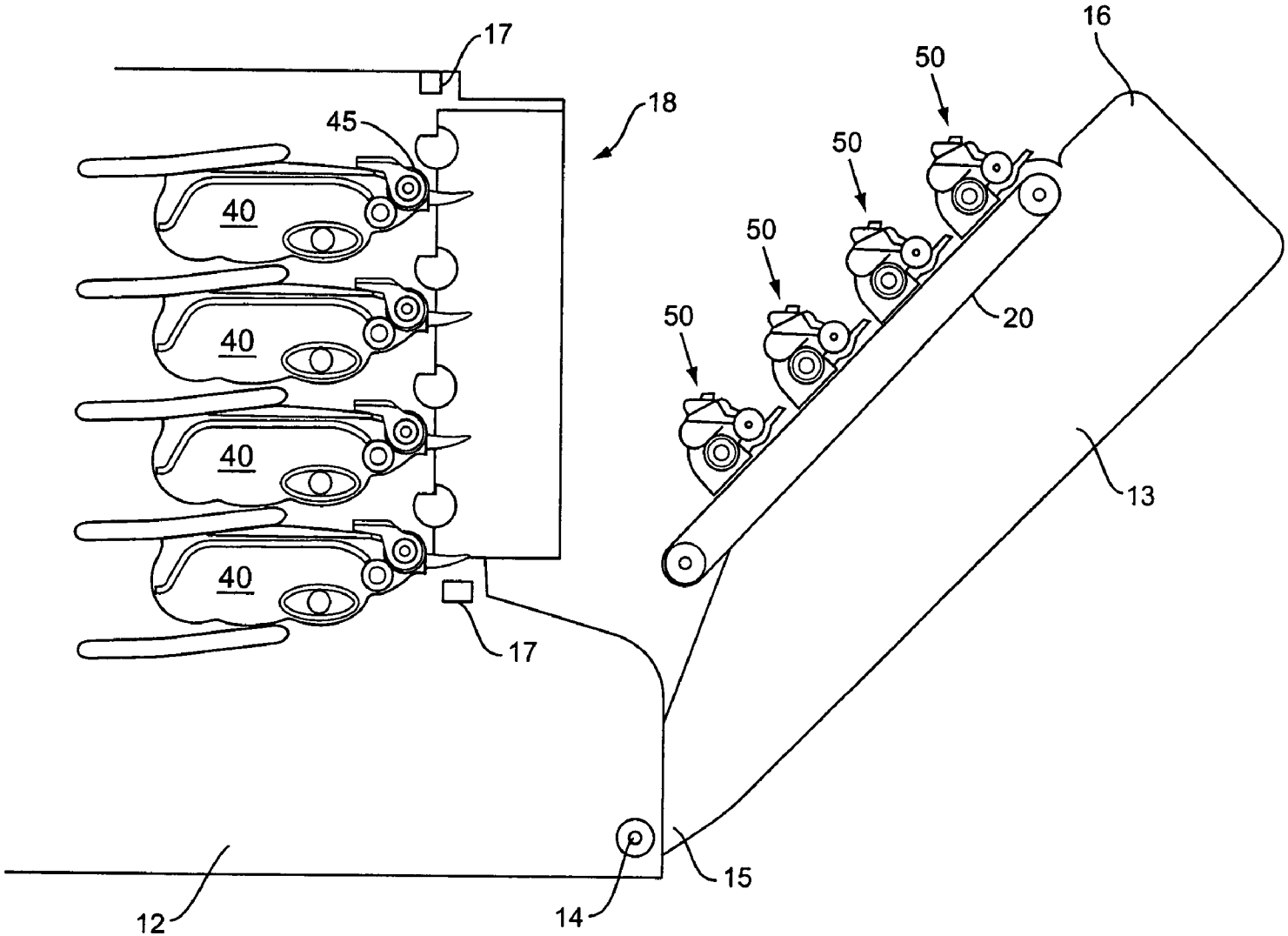
FIG. 3 is a is a cut-away side view of a door in an open orientation according to one embodiment of the present invention.

As illustrated in FIGS. 1 and 2, the image forming units 100 are constructed of a developer unit 40 and a photoconductor unit 50. The developer unit 40, including a developer member 45, is positioned within the main body 12. The photoconductor unit 50, including a photoconductive member 51, is mounted to the door assembly 13. In a closed orientation as illustrated in FIG. 1, the door assembly 13 is positioned adjacent to the main body 12 with the photoconductive member 51 of the photoconductor unit 50 against the developer member 45 of the developer unit 40. In an open orientation as illustrated in FIG. 3, the door assembly 13 is moved away from the main body 12 separating the photoconductor unit 50 from the developer unit 40. This configuration provides direct and easy user access to the developer unit 40, photoconductor unit 50, and the media path. It has been determined that the highest user intervention rates are at the developer unit 40, photoconductor unit 50, and media path.

FIG. 2 illustrates a cross-sectional view of the image forming unit 100 in the closed orientation. The developer unit 40 comprises an exterior housing 43 that forms a reservoir 41 for holding a supply of toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The developer unit 40 is structured with the developer member 45 on an exterior section where it is accessible for contact with the photoconductive member 51.

The photoconductor unit 50 is illustrated in FIG. 2 and comprises the photoconductive member 51, and a charger 52. In one embodiment, the photoconductive member 51 is an aluminum hollow-core drum coated with one or more layers of light-sensitive organic photoconductive materials. Charger 52 applies an electrical charge to the photoconductive member 51 to receive an electrostatic latent image from the imaging device 22 (FIG. 1). A cleaner blade 53 contacts the surface of the photoconductive member 51 to remove toner that remains on the photoconductive member 51. The residual toner is moved to a waste toner auger 54 and moved out of the photoconductor unit 50. A housing 56 forms the exterior of a portion of the photoconductor unit 50. The photoconductive member 51 is mounted protruding from the photoconductor unit 50 to contact the developer member 45.

In this two-piece cartridge architecture, the developer unit 40 and photoconductor unit 50 are mounted to ensure good contact axially along a developer nip 46 across a print zone between the developer member 45 in the developer unit 40 and the photoconductive member 51 in the photoconductor unit 50. The accurate placement of each of the developer unit 40 and photoconductor unit 50 is important for uniform contact pressure along the full axial extent of the developer nip 46.

As illustrated in FIG. 3, the main body 12 has enclosed sides forming an opening 18 for mounting the developer units 40. Developer units 40 are positioned within the opening 18 with the developer roll 45 extending outward to contact the photoconductive member 51 during image formation. Opening 18 may be sized to encompass the entire side of the main body 12, or may comprise only a limited portion of one side. In the embodiment of FIG. 3, opening 18 is positioned on a lateral side of the main body 12. Opening 18 may also be positioned on the top or bottom side of the main body 12 depending upon the application.

Door assembly 13 is movably attached relative to the main body 12 between an opened orientation as illustrated in FIG. 3 and a closed orientation as illustrated in FIG. 1. The door assembly 13 may be attached to the main body 12 in a variety of manners. FIG. 3 illustrates one embodiment with the door assembly 13 pivotally attached to the main body 12 through a pivot 14. Pivot 14 may attach the main body 12 and door assembly 13 at a variety of locations, such as towards a lower edge 15. In the open orientation, the door assembly upper edge 16 is spaced from the main body 12. This orientation provides access to the developer units 40, photoconductive units 50, and media path. In the closed orientation, the upper edge 16 is in proximity to the main body 12. The upper edge 16 may be in contact with the main body 12, or slightly spaced apart from the main body 12. One or more locks 17 maintain the door assembly 13 in the closed orientation and provide tactile feedback to the user to indicate when the door assembly 13 is in the closed orientation. In one embodiment, a total of four locks 17 connect the door assembly 13 to the main body 12 with two locks each on an upper and lower portion of the opening 18.

Figure 4:
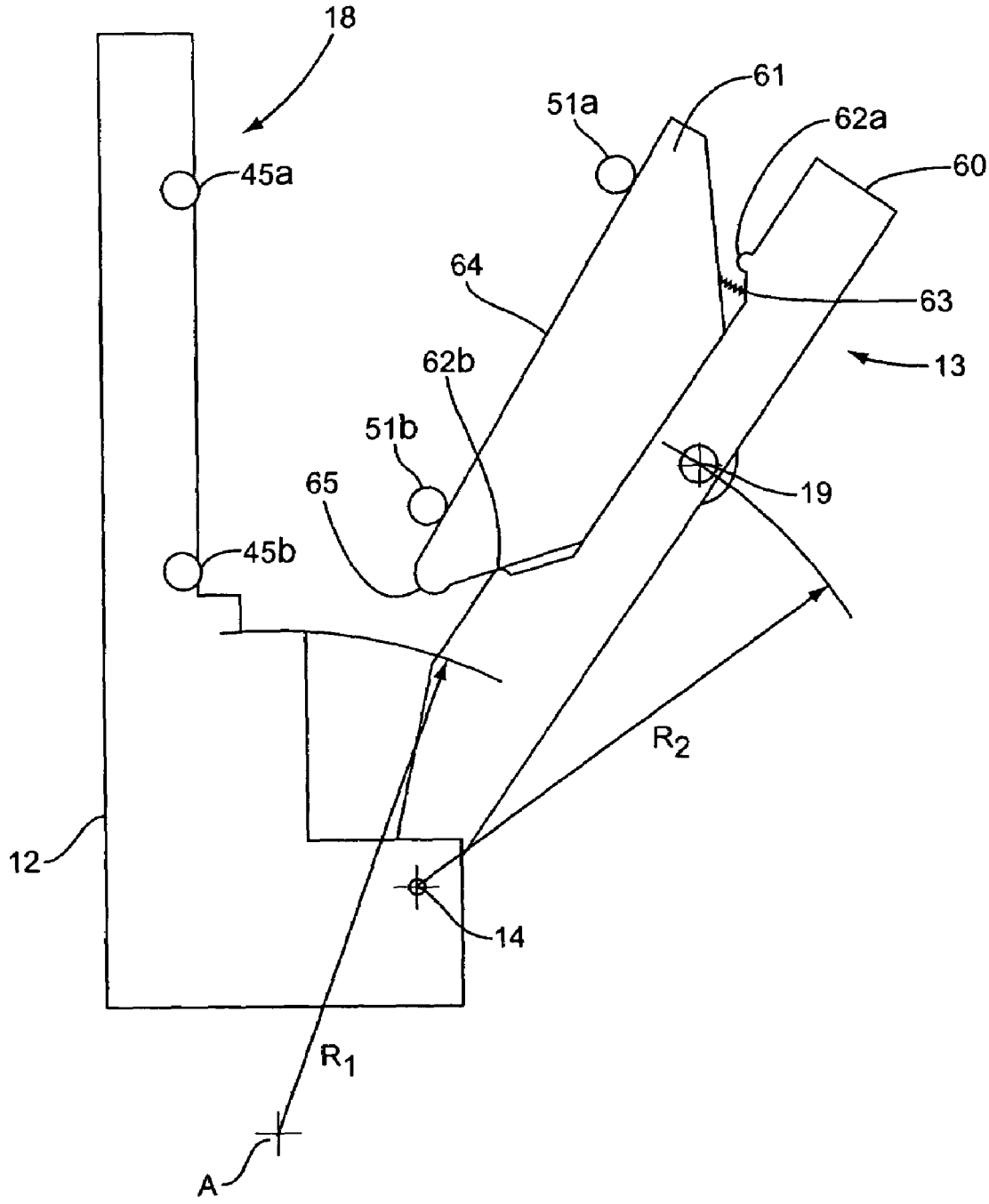
FIG. 4 is a schematic view of the door in the open orientation according to one embodiment of the present invention.
Figure 5:
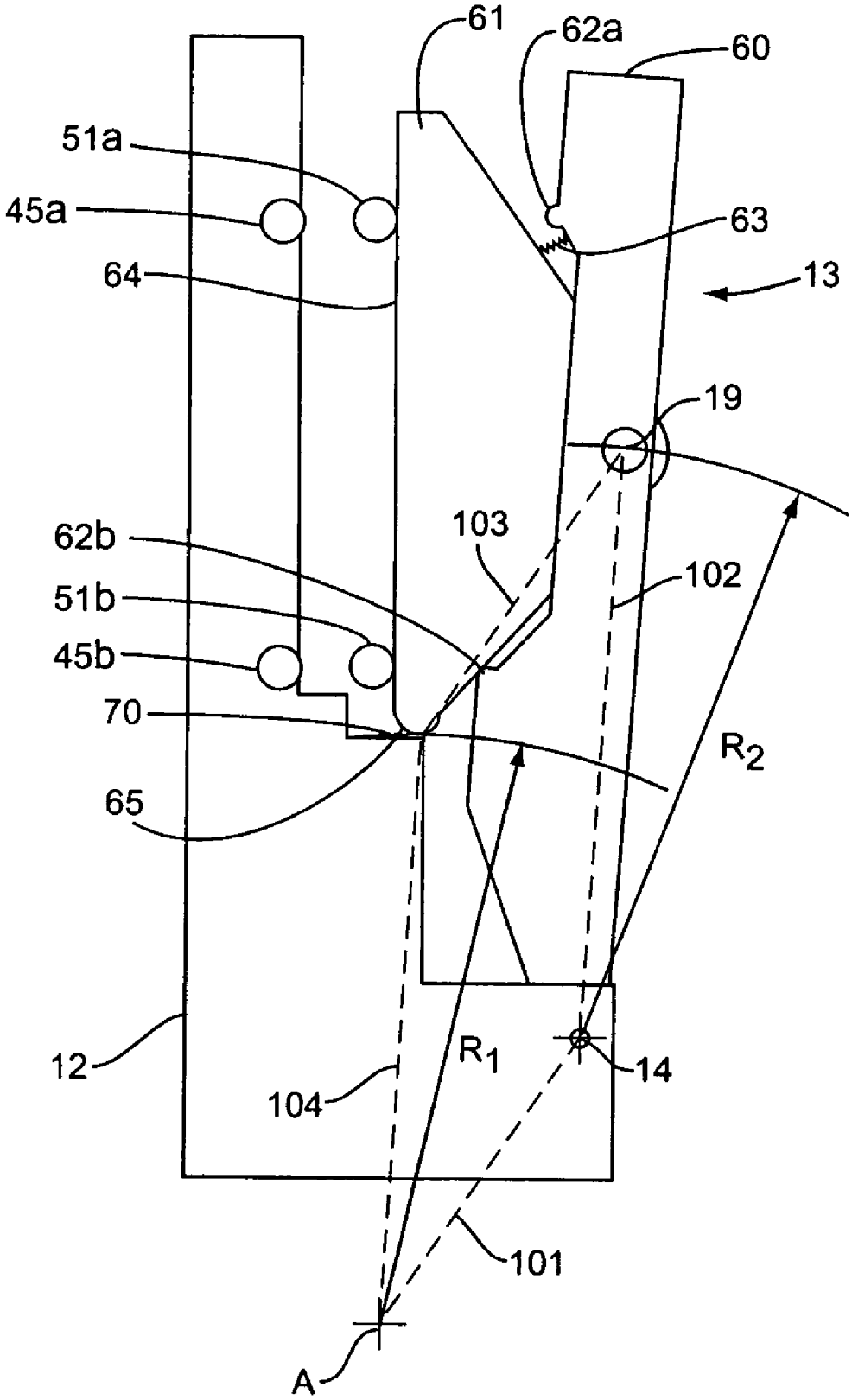
FIG. 5 is a schematic view of the door in an intermediate orientation according to one embodiment of the present invention.
Figure 6:
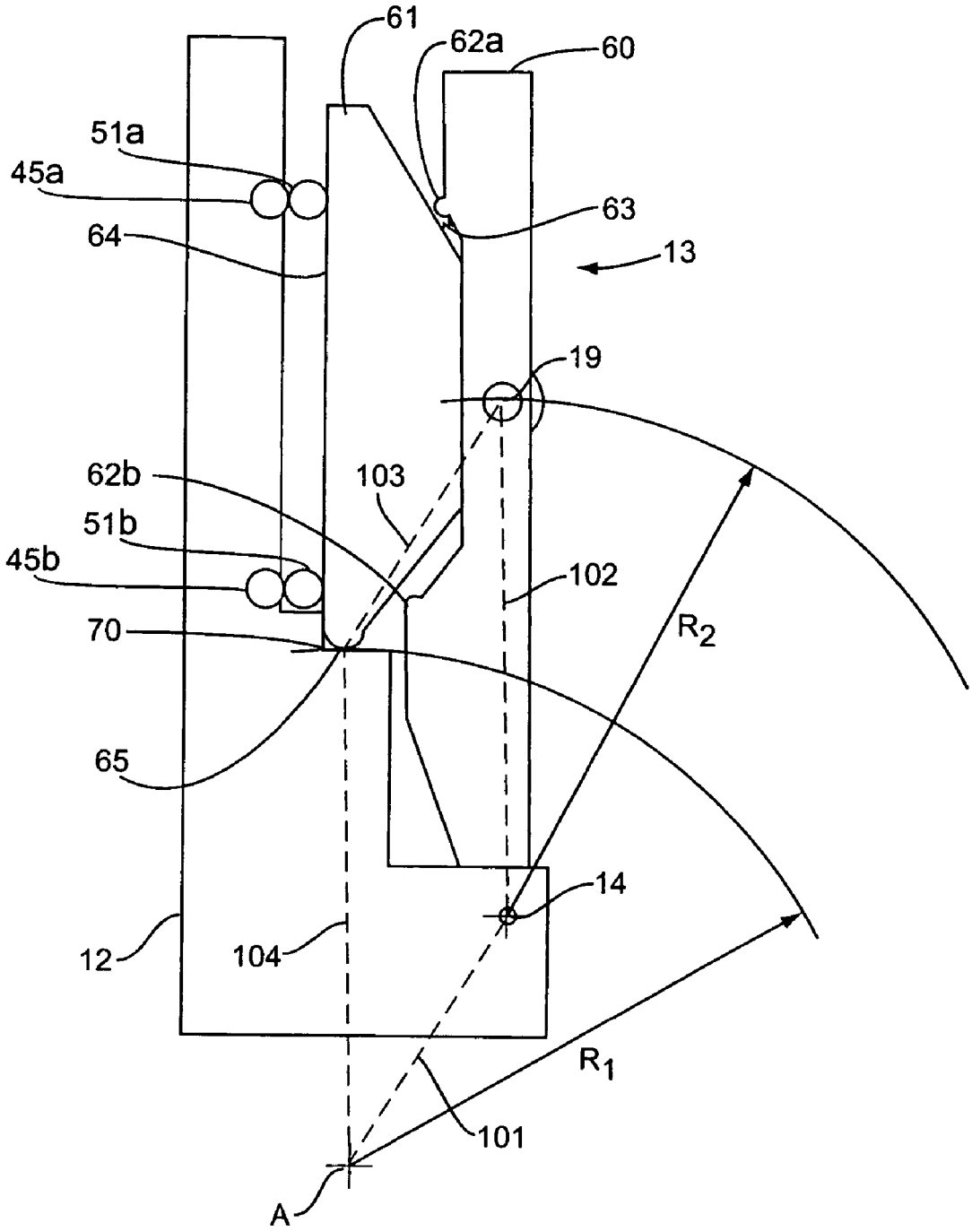
FIG. 6 is a schematic view of the door in a closed orientation according to one embodiment of the present invention.

The door assembly 13 comprises a first frame 60 and a second frame 61 as illustrated in FIGS. 4, 5, and 6. The first frame 60 is movably attached to the main body 12, such as at the first pivot 14. The first frame 60 is sized to extend over the opening 18 when the door assembly 13 is in the closed orientation.

The second frame 61 is pivotally attached to the first frame 60 at a second pivot 19. The second pivot 19 allows the second frame 61 to move relative to the first frame 60. Stops 62 extend from the first frame 60 to control the extent of movement of the second frame 61. The second frame 61 includes a first side 64 so the photoconductive members 51 face towards the main body 12 when the door assembly 13 is in the closed orientation. In the closed orientation, the second frame 61 is accurately aligned with the main body 12 such that the photoconductive members 51 are aligned with the developer rolls 45.

The second pivot 19 allows for relative movement between the second frame 61 and the first frame 60. The second frame 61 can move relative to the first frame 60 as the door assembly 13 moves between the open and closed orientations. The allowable motion between the first frame 60 and the second frame 61 is minimized radially at pivot 19 to maintain positional control of the second frame 61 and photoconductive members 51, but have enough allowable radial movement so as not to impart unwanted forces to the first side 64 when the door assembly 13 is in the closed orientation. Further, the second pivot 19 transmits a force applied from the first frame 60 to the second frame 61 when the door assembly 13 is moved between the open and closed orientations.

As illustrated in FIG. 5, the second frame 61 further comprises a contact surface 65 that contacts the main body 12 to accurately position the second frame 61 and attached photoconductive members 51 in the closed orientation. Contact surface 65 contacts a contour surface 70 to position the second frame 61 relative to the main body 12. Accurate location of the second frame 61 causes the attached photoconductive members 51 to be accurately positioned relative to the corresponding developer rolls 45 within the main body 12. In the closed orientation, the accurate alignment places the photoconductive member 51 and developer roll 45 in contact such that toner passes from the developer roll 45 to the photoconductive member 51 for image formation.

Figure 7:
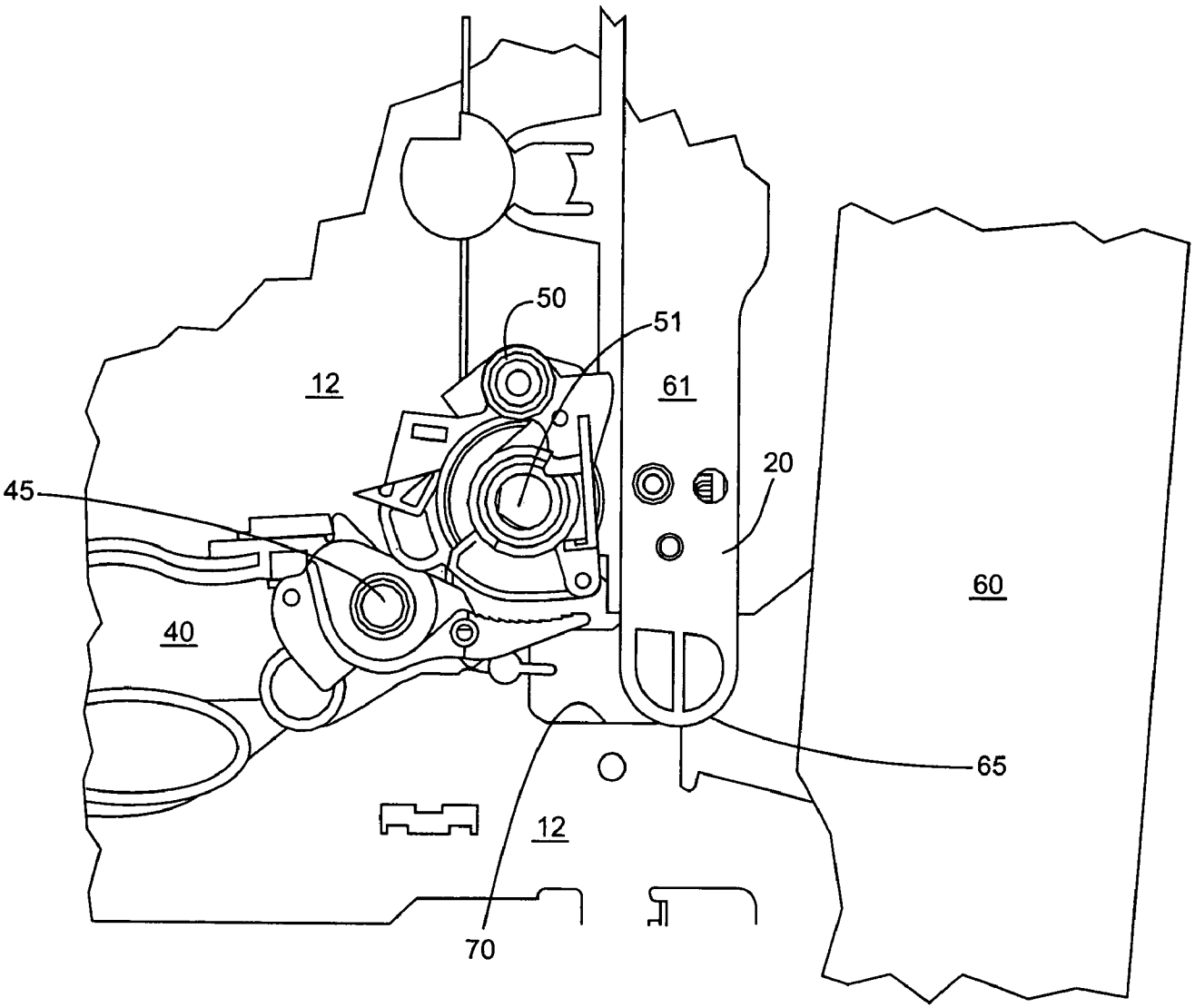
FIG. 7 is a cut-away partial side view of the frame contacting the main body according to one embodiment of the present invention.

The size, shape, and location of the contact surface 65 and the contour surface 70 may vary depending upon the application. In the embodiment illustrated in FIG. 7, a transport belt support acts as the contact surface 65. The contact surface 65 is positioned on a lower section of the second frame 61, and aligns with the contour surface 70 positioned on a lower section of the main body 12. The surfaces 65, 70 may also be located on upper or side sections of the door assembly 13 and main body 12 depending upon the application. In one embodiment, the contour surface 70 has a length of about 15 mm.

In one embodiment illustrated in FIGS. 4, 5, and 6, the contour surface 70 has a shape equal to a radius formed by a line with a length R2. Length R2 is the distance between the first pivot 14 and the second pivot 19. In one embodiment, a friction-reducing element (not illustrated) is positioned on the door assembly 13.

FIGS. 4, 5, and 6 illustrate a schematic progression as the door assembly 13 moves from the open orientation to the closed orientation. The open orientation in FIG. 4 includes the upper edges of the first and second frames 60, 61 spaced from the main body 12. The second frame 61 is pivoted downward about second pivot 19 with a lower edge resting on the lower stop 62*b* and the upper edge being spaced from the upper stop 62*a*. This orientation may be caused by the weighting of the second frame 61, or by a biasing mechanism 63 that extends between the first frame 60 and the second frame 61. Biasing mechanism 63 acts as a dampener when the contact surface 65 contacts the contour surface 70 at the intermediate orientation, and also allows for a smooth closing motion between the intermediate orientation and the closed orientation.

Movement of the first and second frames 60, 61 from the open orientation to the intermediate orientation is rotational about the first pivot 14. The travel distance of a point on the door assembly 13 increases with the distance from the first pivot 14. Therefore, a first photoconductive member 51*a* mounted towards an upper edge of the second frame 61 has a greater travel distance than a second photoconductive member 51*b* mounted towards a lower edge.

FIG. 5 illustrates the intermediate orientation when the contact surface 65 first contacts the contour surface 70. Because the second frame 61 is resting against the lower stop 62*b* when moving from the open orientation to the intermediate orientation, the contact surface 65 is the first part of the second frame to make contact with the main body 12. The first and second developer members 45*a*, 45*b* mounted within the main body 12 are spaced from the second frame 61.

FIG. 6 illustrates the closed orientation with the photoconductive members 51 positioned adjacent to the developer members 45 for toner to pass during image formation. The second frame 61 moves relative to the second pivot 19 while moving from the intermediate orientation to the closed orientation. This is seen as the lower edge moves away from the lower stop 62*b*. When the door assembly 13 is in the closed orientation, the photoconductor units 50 are aligned relative to the main body 12. In the closed orientation, the first photoconductive member 51*a* is aligned with the first developer member 45*a*, and the second photoconductive member 51*b* is aligned with the second developer member 45*b*.

In one embodiment, the door assembly 13 can be represented by a four-bar linkage when moving between the intermediate orientation and the closed orientation as illustrated in dashed lines in FIGS. 5 and 6. A first link 101 extends between point A and the first pivot 14. A second link 102 extends between the first pivot 14 and the second pivot 19. A third link 103 extends between the second pivot 19 and the contact surface 65. A fourth link 104 extends between the contact surface 65 and point A.

R2 is the distance between the first pivot 14 and the second pivot 19. R1 is set equal to R2 and defined between the contour surface 70 and point A. The radius R2 defines the shape of the contour surface 70. Because R1 is a discrete length, the contour surface 70 has a curved configuration. As the second frame 61 moves from the intermediate orientation to the closed orientation, the contact surface 65 slides along the contour surface 70 and each of the photoconductive members 51 have substantially the same travel path, including substantially the same angle of approach towards the main body 12, and substantially the same travel distance. Therefore, photoconductive member 51*a* located most remotely from the first pivot 14 aligns and mates with its respective developer member 45 in the main body 12 in the same manner as photoconductive member 51*b*.

The travel path of the photoconductive members 51 is not completely horizontal because the contour surface 70 has a curved configuration (if R1 had an infinite length, contour surface 70 would be perfectly horizontal and the travel path would be completely horizontal). Therefore, the photoconductive members 51 have an angle of approach relative to the developer members 45. The highest vertical point may be positioned at any location between the inner and outer edge of the contour surface (i.e., anywhere between the intermediate and closed orientations).

The 4-bar linkage controls the approach of the photoconductive members 51 from the intermediate orientation to the closed orientation. In one embodiment, R1 is equal to R2, and links 102 and 104 are parallel during the range between the intermediate and closed orientations. The first side 64 stays substantially parallel to the face of the opening 18 where the developer members 45 are located. In one embodiment, the first side 64 is substantially vertical as the door assembly 13 moves from the intermediate to closed orientations, and the first pivot 14 is located vertically below the second pivot 19, and the photoconductive members 51*a*, 51*b* are vertically aligned.

When the door assembly 13 is opened beyond the intermediate orientation, the contact between the contact surface 65 moves from the contour surface 70 when 62*b* contacts 61 and the 4-bar linkage is broken. This motion includes the second frame 61 moving in rotational motion about the first pivot 14.

The contour surface 70 and contact surface 65 may have a variety of shapes and sizes. In another embodiment, the contour surface 70 is approximated to be similar to radius R2. Additionally, manufacturing tolerances may result in the contour surface 70 having a slightly different shape than that mathematically determined as R2. In one embodiment, the contour surface is within 5% of R2. In one embodiment, contour surface 70 is flat.

The term "image forming device" and the like is used generally herein as a device that produces images on a media sheet. Examples include but are not limited to a laser printer, ink-jet printer, fax machine, copier, and a multi-functional machine. One example of an image forming device is Model No. C750 available from Lexmark International, Inc. of Lexington Ky.

Another embodiment of a two-piece cartridge and door assembly is disclosed in U.S. patent application Ser. No. 10/804,628 entitled "Movable Subunit and Two Piece Cartridge for Use in an Image Forming Device" filed concurrently herewith, assigned to Lexmark International, Inc., and incorporated herein by reference in its entirety.

The embodiments illustrate a transfer belt 20 used for moving the media sheets past the image forming units 100. In another embodiment, nip rollers are used for holding and propelling the media sheets. Various other forms of media movement devices may also be used in the present invention.

In one embodiment, the photoconductor unit 50 is attached to the door assembly 13 via a plurality of mounts. One embodiment of the structure on the door assembly and photoconductor unit is disclosed in U.S. patent application Ser. No. 10/804,551 entitled "Door Assembly for an Image Forming Device", filed concurrently with the present application, and incorporated herein by reference in its entirety.

Figure 8:
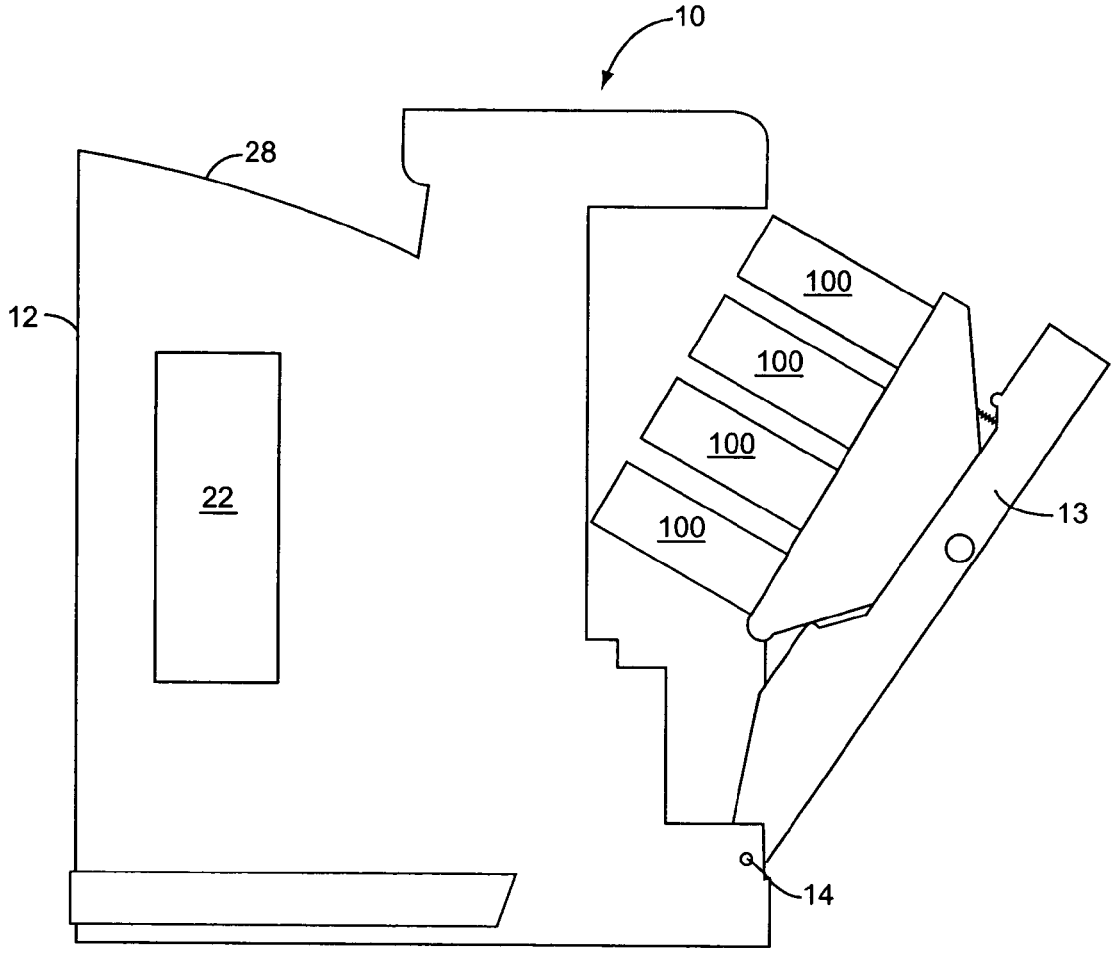
FIG. 8 is a schematic view of a one-piece image forming unit with the door assembly in an open orientation according to one embodiment of the present invention.
Figure 9:
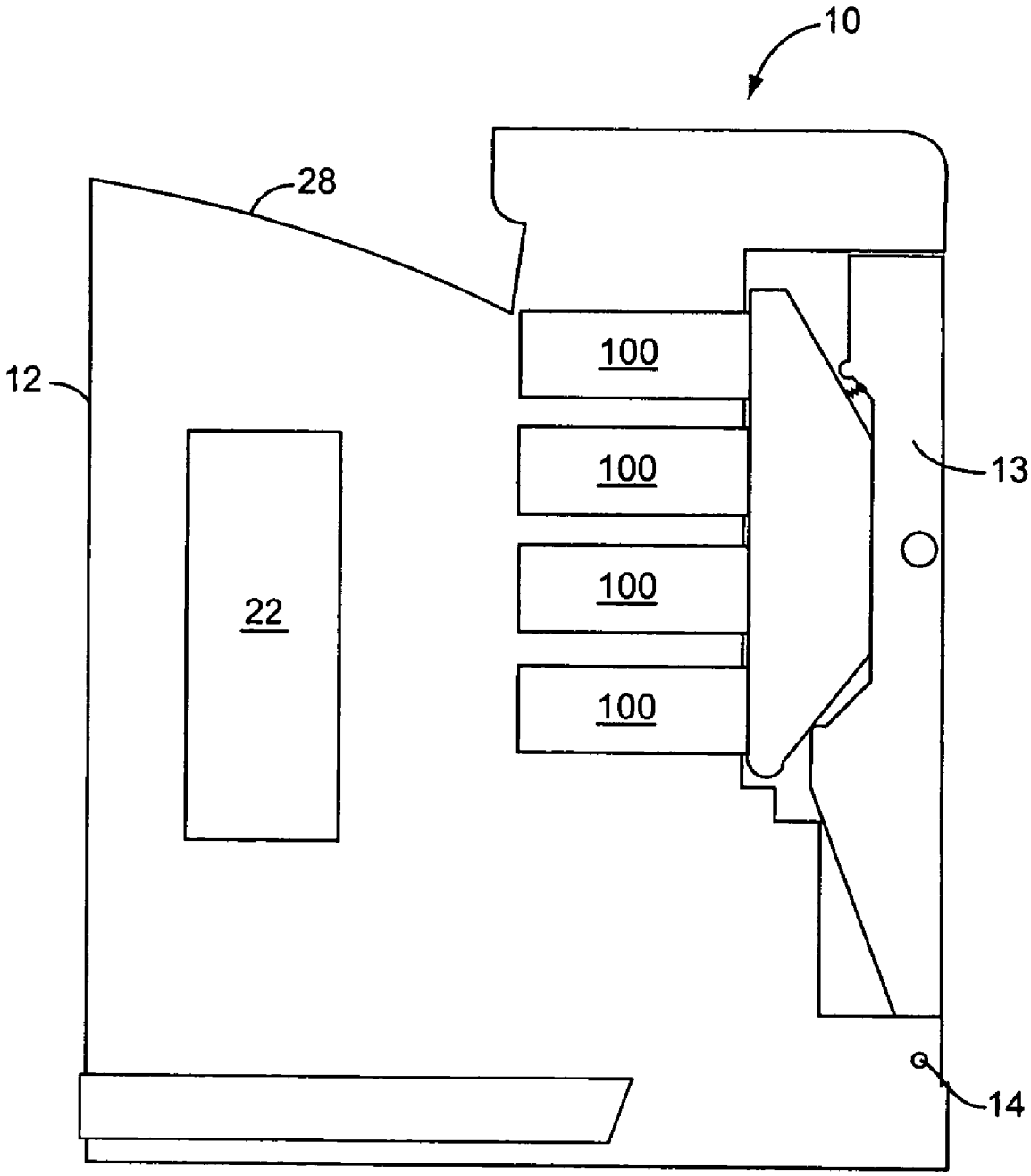
FIG. 9 is a schematic view of the device of FIG. 8 with the door assembly in a closed orientation according to the present invention.

FIGS. 8 and 9 illustrate another embodiment of the invention. One or more image forming units 100 including both developer and photoconductive elements are mounted on the door assembly 13. In one embodiment, the elements of the developer unit 40 and the elements of the photoconductor unit 50 are both contained within a one-piece cartridge that is mounted on the door assembly 13. In the open orientation illustrated in FIG. 8, the image forming units 100 are positioned away from the imaging device 22 within the main body 12. In the closed orientation of FIG. 9, the door assembly 13 accurately mounts the image forming units 100 within the main body 12.

The present invention may be carried out in other specific ways than those herein set forth without departing from the scope and essential characteristics of the invention. In one embodiment, the upper stop is an over-travel stop that controls the extent of movement of the second frame 61 about the second pivot 19. During normal use, the second frame 61 does not contact the upper stop 62*a*. In one embodiment, the first side 64 is formed by the transport belt 20. The present embodiments are, therefore, to be considered in all respects as illustrative and not restrictive, and all changes coming within the meaning and equivalency range of the appended claims are intended to be embraced therein.

What is claimed is:

1. An image forming device comprising:

a body;

a developer member mounted to the body;

a first frame pivotally mounted to the body at a first pivot and positionable between an open orientation positioned away from the body and a closed orientation positioned in proximity to the body;

a second frame pivotally connected to the first frame at a second pivot and further comprising a photoconductive member that aligns to the developer member when the first frame is in the closed orientation, the second frame further having an alignment edge; and a contour surface within the body having a length greater than the alignment edge, the contour surface being contacted by the alignment edge as the first frame moves from the open orientation to the closed orientation to align the photoconductive member relative to the developer member.

2. The device of claim 1, wherein the contour surface extends between an inner edge towards the body and an outer edge towards the first frame, a vertical high point of the contour surface is located at the outer edge.

3. The device of claim 1, wherein the contour surface extends between an inner edge towards the body and an outer edge towards the first frame, a vertical high point of the contour surface is located at the inner edge.

4. The device of claim 1, wherein the contour surface is located on a lower half of the body.

5. The device of claim 1, wherein the alignment edge is formed by a transfer belt assembly.

6. The device of claim 1, further comprising stops extending outward from the first frame on each side of the second pivot to control an extent of movement of the second frame relative to the first frame.

7. The device of claim 6, further comprising a biasing member extending between the first frame and the second frame to position the second frame against one of the stops when the first frame is in the open orientation.

8. The device of claim 1, further comprising a biasing mechanism positioned between the first frame and the second frame to dampen the movement of the second frame as the alignment edge moves along the contour surface.

9. The device of claim 1, further comprising an imaging unit within the body to form a latent image on the photoconductive member, the second frame positioning the photoconductive member at a predetermined location relative to the imaging unit when the first frame is in the closed orientation.

10. The device of claim 1, wherein the second frame is pivotally connected to the first frame at a position above the contour surface when the first frame is in the closed orientation.

11. The device of claim 1, wherein the first frame contacts the body in the closed orientation.

12. The device of claim 1, wherein the contour surface has a curved shape.

13. The device of claim 12, wherein the contour surface is curved an amount equal to a radius of a line that extends between the first pivot and the second pivot.

14. An image forming device comprising:

a body;

a first developer member and a second developer member each positioned within the body;

a first frame having a first end and a second end;

a first pivot adjacent to the first end that connects the first frame to the body, the first frame being relatively positionable between a first orientation with the second end distanced from the body, and a second orientation with the second end in proximity to the body;

a second frame having a first photoconductive member and a second photoconductive member; and a second pivot that connects the second frame to the first frame and causing the second frame to pivot separately from the first frame and positioning the first photoconductive member in contact with the first developer roll and the second photoconductive member in contact with the second developer roll when the first frame is in the second orientation.

15. The device of claim 14, wherein the second end contacts the body in the second orientation.

16. The device of claim 14, wherein the first pivot is located vertically below the second pivot when the first frame is in the second orientation.

17. The device of claim 14, further comprising the first photoconductive member mounted towards a first end of the second frame distant from the first pivot, and the second photoconductive member mounted towards a second end of the second frame proximate to the first pivot, with the first photoconductive member and the second photoconductive member being vertically aligned when the first frame is in the second orientation.

18. The device of claim 14, wherein the second frame comprises a face opposite from a connection with the second pivot, the face being substantially vertical in the second orientation.

19. An image forming device comprising:

a body;

a plurality of developer members mounted to the body;

a first frame pivotally mounted to the body at a first pivot and positionable between an open orientation positioned away from the body and a closed orientation positioned in proximity to the body;

a second frame pivotally connected to the first frame at a second pivot and further comprising a plurality of photoconductive members that each align to a corresponding one of the plurality of developer members when the first frame is in the closed orientation, the second frame further having an alignment edge; and a contour surface within the body, the contour surface being contacted by the alignment edge as the first frame moves from the open orientation to the closed orientation and having a curved shape equal to a radius formed by a line with a length equal to a distance between the first pivot and the second pivot.

20. An image forming device comprising:

a body having a contour surface;

a first frame having a first end and a second end;

a first pivot adjacent to the first end that connects the first frame to the body;

a second frame having an alignment edge; and a second pivot that connects the second frame to the first frame and causing the second frame to pivot separately from the first frame;

the first frame being relatively positionable between a first orientation with the alignment edge distanced from the contour surface and the second frame positioned relative to the first pivot, and a second orientation with the alignment edge in contact with the contour surface and the second frame positioned relative to the body.

21. The device of claim 20, wherein the contour surface is substantially flat.

22. A method of moving a door assembly on an image forming device, the method comprising the steps of:

moving a door assembly from an open orientation to an intermediate orientation in a first travel path defined by a first pivot, the door assembly comprising a first frame attached to a body at the first pivot, and a second frame attached to the first frame at a second pivot;

contacting the second frame with a contour surface in the body as the door assembly moves from the intermediate orientation to a closed orientation; and moving the door assembly from the intermediate orientation to the closed orientation and moving the first frame in the first travel path defined by the first pivot and moving the second frame in a second travel path defined by the contour surface.

23. The method of claim 22, further comprising positioning a photoconductive member on the door assembly against a developer roll in the body when the door assembly is in the closed orientation.

24. The method of claim 22, wherein moving along the first travel path is rotational movement.

25. The method of claim 22, wherein the second travel path is formed by moving a contact surface of the second frame against a contour surface of the body.

26. The method of claim 25, wherein the second travel path is curved because the contour surface has a curved shape.

27. The method of claim 25, wherein the second travel path is substantially straight because the contour surface is flat.

28. A method of moving a door assembly on an image forming device, the method comprising the steps of:

positioning a first developer member and a second developer member in a body;

attaching a first photoconductive member and a second photoconductive member to a second frame;

moving a door assembly with a first movement type from an open orientation to an intermediate orientation, the door assembly comprising a first frame and the second frame;

contacting the second frame against the body as the door assembly moves to the intermediate orientation; and moving the door assembly to a closed orientation with the first frame moving with a first movement type and the second frame moving in a second movement type different from the first movement type.

29. The method of claim 28, further comprising moving the first frame and the second frame about a first pivot between the open orientation and the intermediate orientation.

30. The method of claim 29, further comprising moving the first frame about the first pivot between the intermediate orientation and the closed orientation.

31. The method of claim 28, further comprising vertically positioning a face of the second frame during movement between the intermediate orientation and the closed orientation.

32. The method of claim 28, further comprising moving a distal point on a face of the second frame a same travel distance as a proximal point on the face of the second frame.

33. The method of claim 28, further comprising dampening the movement of second frame relative to the first frame when moving between the intermediate orientation and the closed orientation.

34. A method of moving a door assembly within an image forming device, the door assembly comprising a first frame pivotally attached to a main body at a first pivot and a second frame pivotally attached to the first frame at a second pivot, the method comprising the steps of:

moving a door assembly from a first orientation to a second orientation and moving a distal point on a second frame a greater distance than a proximal point;

contacting a contact point on the second frame with a contour surface on the main body at the second orientation;

moving the door assembly from the second orientation to a third orientation and sliding the contact point along the contour surface; and moving the distal point and the proximal point an equal distance when moving the door assembly from the second orientation to the third orientation.

35. The method of claim 34, further comprising rotating the second frame about a second pivot when moving the door assembly from the second orientation to the third orientation.

36. The method of claim 34, further comprising contacting a photoconductive member on the second frame against a developer member within the main body at the third orientation.

37. The method of claim 34, further comprising maintaining a face of the second frame in a vertical orientation when moving the door assembly between the second orientation and the third orientation.

38. The method of claim 34, further comprising positioning a first pivot that connects the first frame to the main body vertically above a second pivot that connects the second frame to the first frame.

* * * * *